US006194644B1

(12) United States Patent
Hendrickson

(10) Patent No.: US 6,194,644 B1
(45) Date of Patent: Feb. 27, 2001

(54) MODULAR ELECTRIC GUITAR

(76) Inventor: Mark G. Hendrickson, Rte. 1 Box 235, Bagley, MN (US) 56621

( * ) Notice: Subject to any disclaimer, the term of this patent is extended or adjusted under 35 U.S.C. 154(b) by 0 days.

(21) Appl. No.: 09/271,723

(22) Filed: Mar. 17, 1999

(51) Int. Cl.[7] ..... G10D 3/00
(52) U.S. Cl. ..... 84/291; 84/293; 84/267; 84/723; 84/725
(58) Field of Search ..... 84/291, 293, 267, 84/723, 725, 730, 733, 734

(56) References Cited

U.S. PATENT DOCUMENTS 4,254,683 * 3/1981 Nulman ..... 84/727
4,638,708 * 1/1987 Kamal ..... 84/293
4,854,210 * 8/1989 Palazzolo ..... 84/726

* cited by examiner

*Primary Examiner*—Robert E. Nappi
*Assistant Examiner*—Shih-yung Hsieh

(57) ABSTRACT

An electric guitar has two structurally independent components. A neck/tailpiece module (10) is set into a docking recess (14) in the body module (12). In operation, the two are simultaneously joined mechanically and electronically by an indexing pin (18) and a wiring connector (48 and 50). The two components are fastened by a single bolt (54). The structural independence of the two members makes possible the utilization of bodies which may be constructed of almost any shape, size or material.

5 Claims, 4 Drawing Sheets

MODULAR ELECTRIC GUITAR

CROSS-REFERENCE TO RELATED APPLICATIONS

Not applicable.

BACKGROUND—FIELD OF INVENTION

This invention relates to electric guitars, specifically to an improved construction which makes possible the utilization of a wide variety of body shapes, functions and materials of construction.

BACKGROUND—DESCRIPTION OF PRIOR ART

The shapes of commercially available electric guitars are not conducive to use by persons who are restricted to a wheelchair by disability: they do not fit well between the arm rests or frame members that many individuals require for support, and they commonly have rounded, polished bodies that are difficult to hold.

Also, persons who are capable of playing a guitar may be unable as a result of amputation or neurological impairment to provide lower body support for the instrument while in a sitting position. The modification of an existing manufactured guitar of prior art to fit a wheelchair has disadvantage in that it renders the guitar unfit for use in other applications.

All guitars heretofore known fail to provide sufficient adaptable or changeable body shapes to serve the special needs of a person with a restrictive disability. Furthermore, they lack the ability to be attached to the chair frame for the purpose of security, positioning and comfort. The physical positioning requirements of persons who have disabilities change over time. Inasmuch, guitars of prior art fail to provide an instrument that can change shape to conform to changing needs.

Electric guitars commonly have four to twelve steel strings. When they are in standard tuning, the area from the tuning keys to the tailpiece is subject to significant tensile stress. Guitar designers have traditionally dealt with problems related to tensile stress by adding wood mass and making the neck/tailpiece continuum part of the body. As a result, the size, shape, composition of materials and function of the instrument has been influenced and restricted by the need for structural strength.

U.S. Pat. No. 4,803,906 to Leo Fender (1989) discloses a guitar having a neck which can be detached from the body. While Fender's model facilitates convenience for service or replacement, it has at least two disadvantages:

(a) By breaking the neck/tailpiece continuum with a bolted joint, it creates a potentially weak articulation point at an area of critical stress.

(b) It does not provide a structurally independent neck/tailpiece unit which can be detached from a body.

(c) It does not provide a structurally independent body which can be detached from the neck/tailpiece unit, thereby freeing the guitar from constraints of shape.

At least two guitars have been proposed which incorporate a neck/tailpiece unit that can be detached and re-attached to respectively compatible bodies. U.S. Pat. No. 4,873,908 to Moore (1989) and 5,315,910 to Stupius (1994) are both limited by the necessity of their connection to components with fixed shapes. They are also disposed to reliance on increased wood mass to provide strength, thereby rendering them less adaptable to space and positioning requirements such as those found in a wheelchair application. Furthermore, in an effort to securely attach structurally interdependent components, both Moore and Stupius sacrifice convenience and expense by employing more than one fastener.

SUMMARY

In accordance with the present invention a modular electric guitar comprises a structurally independent neck/tailpiece unit which joins mechanically and electronically with a structurally independent and changeable body.

OBJECTS AND ADVANTAGES

Accordingly, several objects and advantages of the present invention are:

(a) to provide an electric guitar which can be produced with an infinite variety of interchangeable body shapes.

(b) to provide an electric guitar whose construction allows for convenient and relatively rapid change from one body to another.

(c) to provide an electric guitar with a detachable neck/tailpiece module, making it possible to mount and adjust the pickup from the back.

(d) to provide an electric guitar whose construction and material composition allow a compact, yet rigid unit throughout the length of its neck/tailpiece module.

(e) to provide an electric guitar whose construction and material composition allow for service and replacement of magnetic pickups without string removal.

(f) to provide an electric guitar which will allow rapid and efficient diagnostic assessment of all electronic components through a single connector.

(g) to provide an electric guitar with a body which has no structural load related to tensile string stress, thereby allowing it to be made from almost any material.

(h) to provide an electric guitar whose two main components can be detached quickly, using only one fastener.

DRAWING FIGURES

ADVANTAGES

Figure 1:
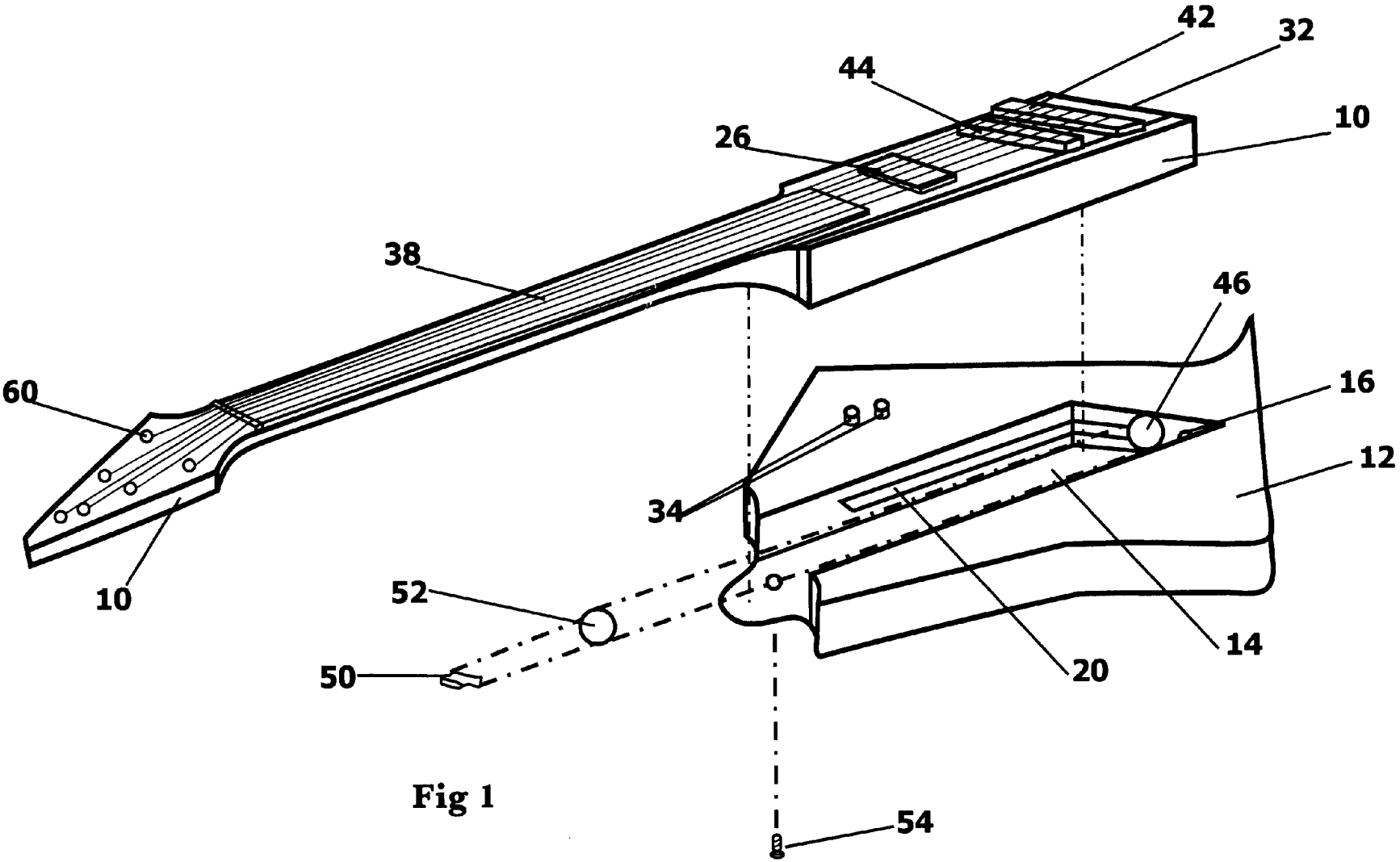
FIG. 1 shows the neck/tailpiece module and a body which is not necessarily of preferred embodiment.

From the descriptions above, a number of advantages of my modular electric guitar become evident:

(a) The magnetic pickup cavities which pierce the docking portion of the neck/tailpiece module are reinforced with laminated graphite composite on each side, thus allowing a narrow, straight, slidable profile.

(b) The laminates of epoxy-graphite composite are so configured that the wider face is perpendicular to the line of stress, thereby adding strength with relatively small mass.

(c) The male wiring connector in the tail end of the prototype neck/tailpiece module will correctly index and align the female wiring connector. Accordingly, the female wiring connector will be aligned and mounted in all succeeding bodies.

(d) The narrow, reinforced neck/tailpiece module facilitates use in bodies which may be restricted by shape, size or orientation.

Operation—FIGS. 1, 2, 5 and 6

The manner of using the modular electric guitar involves its assembly from two compatible components into an operable instrument. This operation is best seen from the perspective of FIG. 1. With the body module 12 resting on a horizontal surface with the docking recess 14 facing upward, the neck/tailpiece module 10 is placed in the docking recess 14. The neck/tailpiece module 10 is then slid toward the tailpiece end of the docking recess 14 until the indexing pin 18 enters the pin recess 16. Simultaneously, the male and female multiple pin wiring connectors 48 and 50 will engage.

The manner of using the modular electric guitar also involves the mounting and adjustment of the magnetic pickup 26. This operation is best seen from the perspective of FIG. 2. The neck/tailpiece module 10 is detached from the body module 12 and laying on a horizontal surface with the strings 38 down. From this perspective, the stepped pickup cavity 22 is accessible. The magnetic pickup 26 may be adjusted for proximity to the strings 38. A predetermined space is held by a compressed spring 22 between the magnetic pickup 26 and the magnetic pickup mounting plate 56. The space is diminished or augmented as the pickup mounting screws 36 are turned clockwise or counter-clockwise in the oversized holes 58 of the pickup mounting plate 56. The threaded ends of the pickup mounting screws 36 engage the treaded holes in the modified pickup mounting flange 30 thereby causing the magnetic pickup 26 to move along the length of the pickup mounting screw 36.

The magnetic pickup 26 can be detached by extracting the pickup mounting plate 56 with the magnetic pickup 26 attached. The pickup mounting screws 36 are then extracted by turning them counter-clockwise until the magnetic pickup 26 falls away. In a likewise manner, the magnetic pickup 26 can be mounted by reversing the above process.

Reference Numerals in Drawings

| | |
|---|---|
| 10 neck/tailpiece module | 12 body module |
| 14 docking recess | 16 indexing pin recess |
| 18 indexing pin | 20 wiring raceway |
| 22 spring | 24 stepped cavity |
| 26 magnetic pickup | 28 prior art pickup mounting flange |
| 30 modified pickup mounting flange | 32 laminated graphite composite |
| 34 potentiometer | 36 pickup mounting screw |
| 38 guitar string | 40 nut |
| 42 tailpiece | 44 bridge |
| 46 stepped terminal cavity | 48 multiple pin wiring connector (male) |
| 50 multiple pin wiring connector (female) | 52 terminal mounting disk |
| 54 body mounting bolt | 56 pickup mounting plate |
| 58 threaded pickup mounting screw hole | |

Description—FIGS. 1, 2, 4A and 4B—Preferred Embodiment

Figure 2:
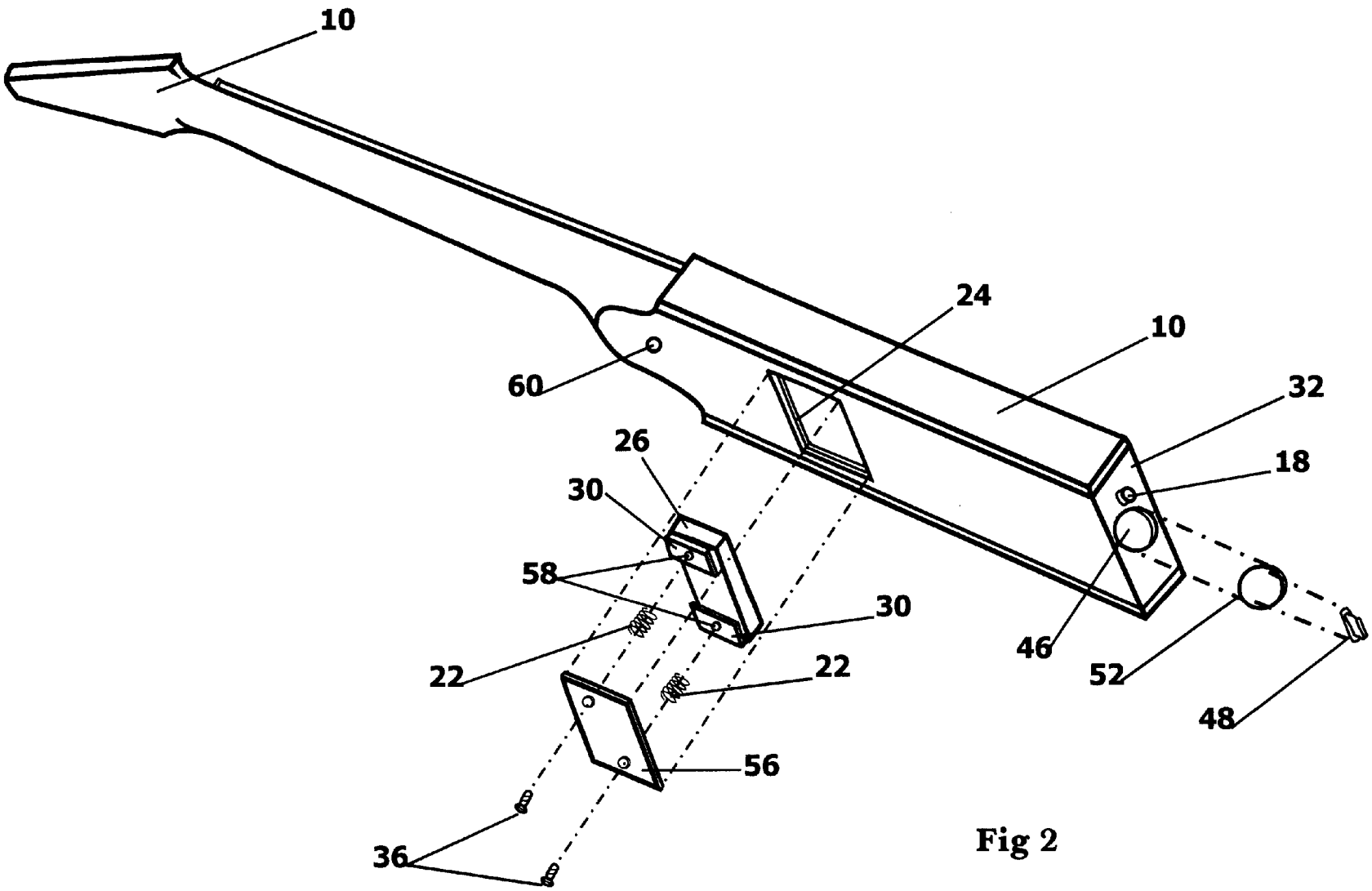
FIG. 2 shows the neck/tailpiece module from a different perspective, showing graphite epoxy composite reinforcement and pickup cavities with exploded means for mounting wiring connector and mounting and adjusting pickup.
Figure 4A:
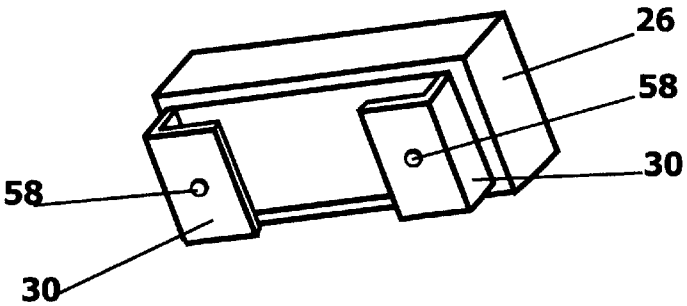
FIG. 4A shows a magnetic pickup after the modification of its mounting flanges.
Figure 4B:
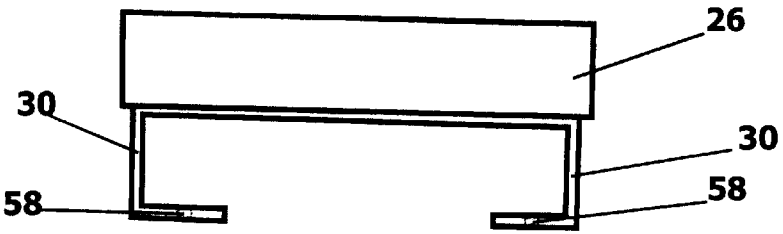
FIG. 4B shows a magnetic pickup after the modification of its mounting flanges from a different perspective.

A preferred embodiment of the present invention is illustrated in FIG. 1 and in FIG. 2, with the exception of the body 12, which has no preferred embodiment in relation to shape. The docking portion of the neck/tailpiece module 10 seen from a tail end perspective (FIG. 2) has two laminated layers of epoxy-graphite composite 32. The cavities for the magnetic pickups 26 run through the neck /tailpiece module 10 perpendicular to the line of the strings 38 and inside the epoxy graphite composite envelope 32.

Figure 3A:
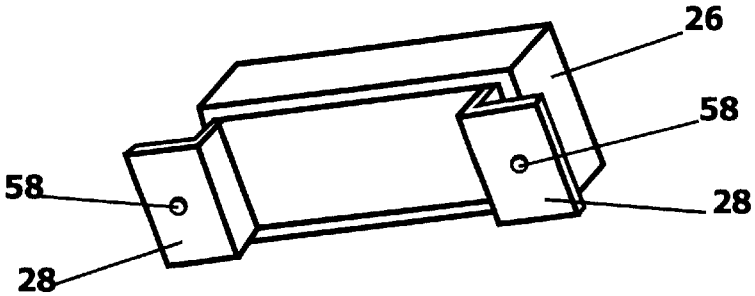
Fig 3A (Prior Art)
FIG. 3A shows a magnetic pickup before the modification of its mounting flanges.
Figure 3B:
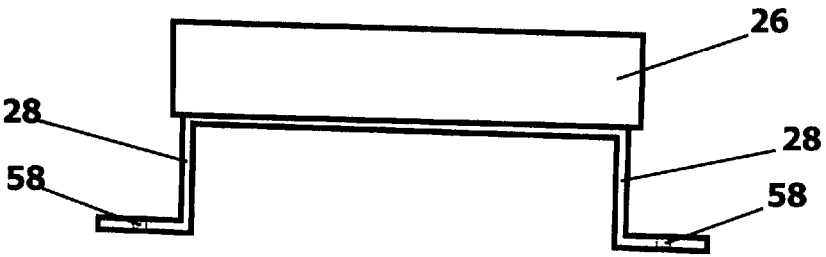
Fig 3B (Prior Art)
FIG. 3B shows a magnetic pickup before the modification of its mounting flanges from a different perspective.
Figure 6:
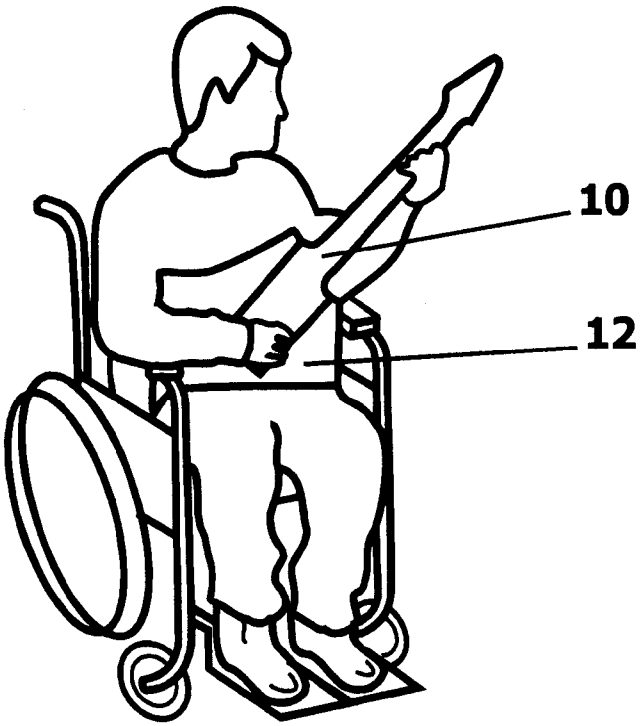
FIG. 6 shows a standing figure using my guitar with a common body shape.
Figure 5:
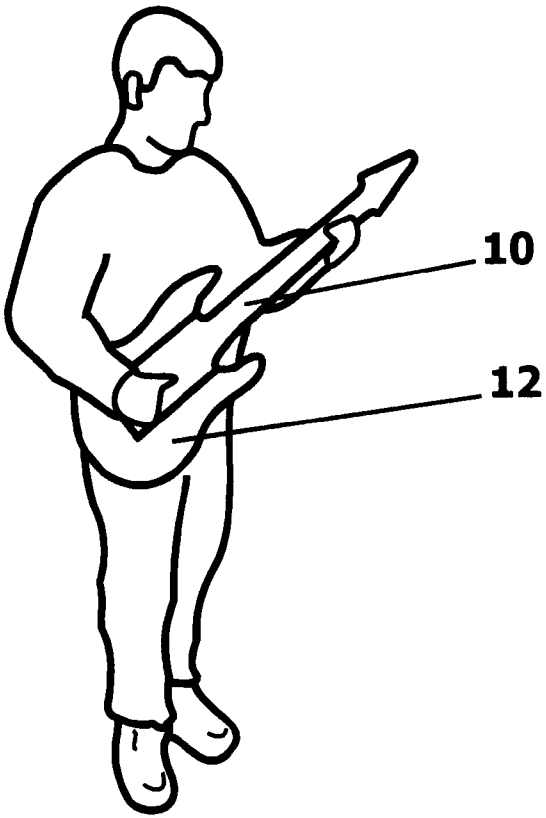
FIG. 5 shows a figure in a wheelchair using my guitar with an adaptive body.

In FIG. 3, prior art magnetic pickup flanges 28 are shown modified 30 to occupy a narrow profile the magnetic pickup in the neck/tailpiece module includes a threaded pickup mounting hole in a mounting flange which is turned 180 degree transversely toward a pickup's center; in the present embodiment, screws 36 and springs 22 are provided for mounting and adjustment. The pickup mounting screws 36 are set into slightly oversized holes 58 in the pickup mounting plate 56, which has been friction-fit into a stepped cavity 24 in the neck/tailpiece module 10.

An embodiment of a guitar body 12, is shown in FIG. 1. Its single preferred embodiment is compatibility with the neck/tailpiece module 10.

A multiple-pin female wiring connector 50 is shown mounted on a flat mounting disk 52 in a stepped cavity 46 at the tail end wall of the docking recess 14.

Although not shown, the wires serving the volume and tone potentiometers 34 run from the terminal 48 through the raceway 20 to the cavities under the potentiometers 34.

What is claimed is:

1. A modular electric guitar comprising:

(a) a neck/tailpiece module;

(b) a body module;

(c) means for attaching said body module to said neck/tailpiece module;

(d) means for mounting and adjusting a magnetic pickup in said neck/tailpiece module;and (e) said magnetic pickup in said neck/tailpiece module includes a threaded pickup mounting hole in a mounting flange is turned 180 degree transversely toward a pickup's center.

2. The guitar of claim 1 wherein said means for mounting and adjusting said magnetic pickup in said neck/tailpiece module includes mounting screws.

3. The guitar of claim 2 wherein said means for mounting and adjusting said magnetic pickup in said neck/tailpiece module includes a flat, rigid plate of predetermined size affixed to a step in a cavity in said neck/tailpiece module.

4. The guitar of claim 2 wherein said flat rigid plate of predetermined size includes holes sufficiently wider than the outside diameter of said mounting screws, whereby said mounting screws turn freely in them.

5. The guitar of claim 2 wherein said means for mounting and adjusting said magnetic pickup in said neck/tailpiece module includes a compressed spring surrounding said mounting screws and between said mounting flange and said flat rigid plate, whereby said magnetic pickup and said attached mounting flange are forced away from each other.

* * * * *